United States Patent [19]

Polaschegg

[11] 4,128,763

[45] Dec. 5, 1978

[54] ENERGY ANALYZER FOR CHARGED PARTICLES

[75] Inventor: Hans-Dietrich Polaschegg, Bornheim, Fed. Rep. of Germany

[73] Assignee: Leybold-Heraeus GmbH & Co. KG, Cologne, Fed. Rep. of Germany

[21] Appl. No.: 802,962

[22] Filed: Jun. 2, 1977

[51] Int. Cl.[2] ..... H01J 39/00

[52] U.S. Cl. ..... 250/305; 250/397

[58] Field of Search ..... 250/305, 309, 310, 396 R, 250/397, 505; 324/71 R, 71 EB

[56] References Cited

U.S. PATENT DOCUMENTS 3,482,091 12/1969 Baldwin ..... 250/396 R 3,805,068 4/1974 Lee ..... 250/305

*Primary Examiner*—Alfred E. Smith

*Assistant Examiner*—B. C. Anderson

*Attorney, Agent, or Firm*—Spencer & Kaye

[57] ABSTRACT

Apparatus for analyzing the energies of charged particles having an analyzer, a detector and an electrode system. The analyzer generates an electric or magnetic field through which the particles pass, there being an outlet aperture through which the charged particles exit as a beam. The detector is arranged in the path of the beam leaving the analyzer field through the outlet aperture, and the electrode system is arranged between the analyzer and the detector and serves to adjust the cross-section of the particle beam.

7 Claims, 6 Drawing Figures

ENERGY ANALYZER FOR CHARGED PARTICLES

BACKGROUND OF THE INVENTION

The invention relates to an energy analyzer for charged particles in which the particles traverse an electric or magnetic field and to a detector system which is connected behind the analyzer and to which are fed the particles after they leave the field of the analyzer through an exit slit. The energy analyzer may be a spherical capacitor, a cylindrical capacitor, a magnetic sector field spectrometer or the like.

When experiments are conducted with prior art devices and samples of different sizes, there exists the danger that — with small samples — the substrate of the sample delivers interfering contributions to the spectrum of the sample. The resolution of a spherical capacitor, for example, is determined by the ratio of the width of the entrance and exit slits, or so-called apertures, to the radius of the spherical capacitor and the aperture of the beam in radial direction. However, the surface of the entrance aperture (width x length) and the aperture of the beam (total solid angle) are determinative of the luminosity (a measure of the sensitivity). The length of the apertures as well as the beam aperture in tangential direction are not included in a first aproximation of the resolution. This applies exactly for the ideal 180° spherical capacitor. In order to obtain as high a sensitivity as possible it is desirable to have the entrance and exit apertures as long as possible. However, this length is limited by 1. the active surface of the detector system employed to detect the particles leaving the exit aperture; and
2. limitations in the illumination of the entrance aperture of the spherical capacitor.

If, for example, in photoelectron spectroscopy the sample is reproduced in the entrance aperture of the spherical capacitor through a system of lenses, the maximum appropriate length of the entrance aperture is given by the length of the sample multiplied by the magnification factor of the lens. In order to attain optimum sensitivity, the aperture length should be adapted to the diameter of the available detector, generally a secondary electron multiplier.

The magnification factor of the lens is then adapted to correspond to the maximum significant sample size. If smaller samples are to be examined which are placed on a substrate, this substrate will inevitably deliver interfering contributions to the spectrum of the sample.

SUMMARY OF THE INVENTION

It is the object of the present invention to provide an energy analyzer for charged particles of the type mentioned above in which these drawbacks no longer occur.

According to the present invention, the above drawbacks are overcome by providing an electrode system between the energy analyzer and the detector system to adjust the cross section of the particle beam. Depending on whether positive or negative particles are being analyzed, a positive or negative voltage can be applied across the electrode system according to the invention, which voltage — depending on the amplitude of the voltage applied — trims, to a greater or lesser extent, the cross section of the particle beam leaving the exit aperture. When changing from a larger to a smaller sample, reducing the cross section of the particle beam leaving the exit aperture will suffice to prevent particles originating from the substrate of the sample from being registered, without changing the optimally adjusted sensitivity.

BRIEF DESCRIPTION OF THE DRAWINGS

Further advantages and details of the invention will be explained in connection with embodiments illustrated in FIGS. 1 through 6.

BRIEF DESCRIPTION OF THE PREFERRED EMBODIMENT

Figure 1:
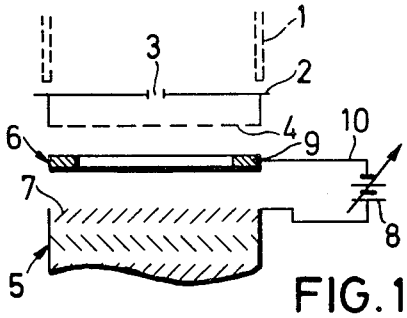
FIGS. 1 and 2 show an embodiment according to the invention which is provided with a ring electrode.

In all figures, the housing of the energy analyzer is indicated at 1, the boundary field limit at 2 and the exit aperture disposed in the boundary field limit at 3. A grid 4 which is intended to prevent penetration of a post-acceleration field between the energy analyzer and the detector system 5 is disposed in front of exit aperture 3. In the illustrated embodiments, the detector system 5 is formed by a secondary electron multiplier.

The electrode system according to the invention is indicated at 6 in all figures. It is biased with respect to cathode 7 (or the first dynode) of the secondary electron multiplier 5 with the aid of voltage source 8. For the analysis of positive particles, the electrode system 6 is positively biased, for the analysis of negative particles, it is negatively biased.

Figure 2:
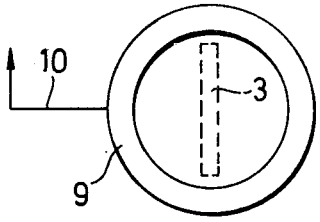

In the embodiment according to FIGS. 1 and 2, the electrode system 6 is formed by a ring-shaped electrode 9 whose inner diameter is somewhat greater than the length of aperture 3. If a voltage which, for example, is negative with respect to the cathode of the secondary electron multiplier, is applied across this electrode via line 10, the opposing field which is effective particularly at the edge of the electrode, limits the particle beam leaving the exit aperture. By varying the amplitude of the applied voltage, the size of the particle beam cross section, and thus the size of the sample range being covered, can be regulated.

Figure 3:
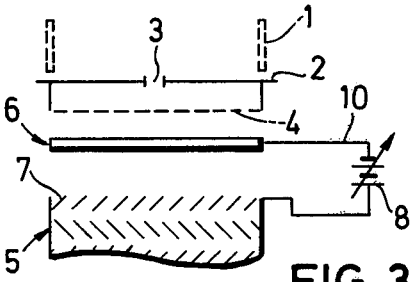
FIGS. 3 and 4 show an embodiment according to the invention which is provided with an electrode system formed by two rod electrodes.
Figure 4:
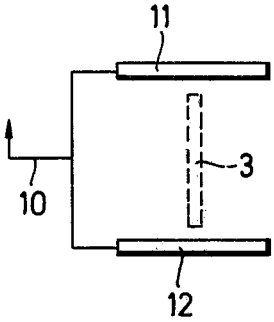

In the embodiment according to FIGS. 3 and 4, the electrode system 6 comprises two rod electrodes 11 and 12 which are arranged perpendicular to aperture 3 and are spaced from one another at a distance somewhat greater than the length of aperture 3. Electrodes 11 and 12 are connected together electrically. The pass-through region is regulated by the amplitude of the voltage applied across cathode 7 of the secondary electron multiplier 5 and the voltage applied across electrodes 11 and 12.

Figure 5:
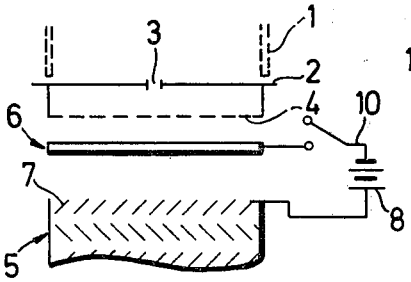
FIGS. 5 and 6 show an embodiment according to the invention which is provided with three pairs of rod electrodes.
Figure 6:
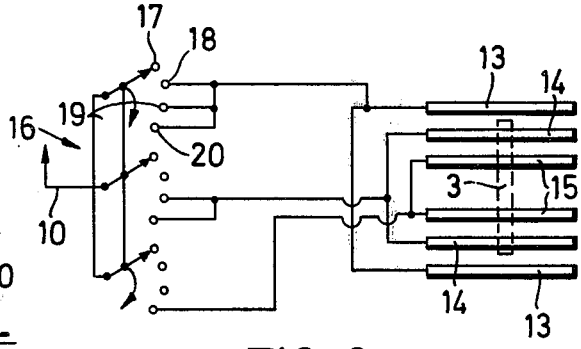

A further embodiment is shown in FIGS. 5 and 6. In this case, the electrode system 6 includes a plurality of (in the present case, three) pairs of electrodes 13, 14 and 15. These are likewise arranged perpendicular to aperture 3. The pairs, which are connected together in each case, are so arranged that, with respect to the center point of slit 3, the electrode pair 13 lies exteriorly and the electrode pair 15 lies interiorly. The electrode pairs are supplied with voltage via a switching system 16 which has four switching positions marked 17, 18, 19 and 20. In the switching position 17, the electrode pairs are without voltage. In the switching position 18, a voltage is applied only across the outer electrode pair 13. In the switching position 19, a voltage is applied across the two outer electrode pairs 13 and 14. In the switching position 20, a voltage is applied across all electrode pairs. The electric field prevents the penetration of positive or negative particles, depending on whether a positive or negative bias is present with respect to the cathode of the secondary electron multiplier. In this way, the cross section of the electron or ion beam can be reduced in stages without it being necessary for the voltage source 8 to be designed as a variable source.

I claim:

1. Apparatus for analyzing the energies of charged particles, comprising: analyzer means for generating an electric or magnetic field through which the particles pass, said analyzer means having an outlet aperture through which the charged particles exit as a beam; a detector arranged in the path of the beam leaving the analyzer field through said outlet aperture; and electrode means provided between said analyzer means and said detector and being connected to a variable voltage source for adjusting the cross section of the particle beam, thereby to allow the size of the particle beam cross section to be adapted to the size of the sample without changing the optimally adjusted sensitivity of the apparatus.

2. Apparatus as defined in claim 1, wherein said voltage source is variable in stages.

3. Apparatus as defined in claim 1, wherein said voltage source is infinitely variable.

4. Apparatus as defined in claim 1, wherein said electrode means comprise a ring electrode.

5. Apparatus as defined in claim 1, wherein said electrode means comprise two parallel rod electrodes arranged perpendicularly to said outlet aperture.

6. Apparatus for analyzing the energies of charged particles, comprising: analyzer means for generating an electric or magnetic field through which the particles pass, said analyzer means having an outlet aperture through which the charged particles exit as a beam; a detector arranged in the path of the beam leaving the analyzer field through said outlet aperture; electrode means provided between said analyzer means and said detector for adjusting the cross section of the particle beam, said electrode means comprising a plurality of mutually parallel pairs of rod electrodes which are arranged perpendicular to said outlet aperture; and means for selectively connecting to a voltage source the pair of rod electrodes which, with reference to the mid-point of said aperture, is the outermost pair, the two outer pairs of rod electrodes, the three outer pairs of rod electrodes, or all pairs of rod electrodes, in consequence of which the size of the particle beam cross section can be adpated to the size of the sample without changing the optimally adjusted sensitivity of the apparatus.

7. Apparatus as defined in claim 6, wherein said connecting means comprise switching means having at least as many switching positions as there are electrode pairs.

* * * * *